United States Patent [19]

Linder et al.

[11] Patent Number: 4,499,867

[45] Date of Patent: Feb. 19, 1985

[54] ARRANGEMENT FOR CONTROLLING A INTERNAL COMBUSTION ENGINE EQUIPPED WITH GLOW PLUGS

[75] Inventors: Ernst Linder, Mühlacker; Winfried Moser, Ludwigsburg; Franz Rieger, Aalen, all of Fed. Rep. of Germany

[73] Assignee: Robert Bosch GmbH, Stuttgart, Fed. Rep. of Germany

[21] Appl. No.: 610,109

[22] Filed: May 14, 1984

[30] Foreign Application Priority Data

May 31, 1983 [DE] Fed. Rep. of Germany ..... 3319652

[51] Int. Cl.[3] ..... F02D 19/02

[52] U.S. Cl. ..... 123/145 A; 123/357; 123/501

[58] Field of Search ..... 123/145 R, 145 A, 179 B, 123/179 BG, 357, 501, 502

[56] References Cited

FOREIGN PATENT DOCUMENTS 2629846 3/1977 Fed. Rep. of Germany ... 123/145 A 18459 1/1982 Japan ..... 123/145 A

*Primary Examiner*—Tony M. Argenbright

*Attorney, Agent, or Firm*—Walter Ottesen

[57] ABSTRACT

The invention is directed to an arrangement for controlling an internal combustion engine equipped with glow plugs. The arrangement includes a heat-control circuit for controlling the temperature of the glow plug and an ancillary control circuit which can be a fuel control circuit for example. The ancillary control circuit takes over from the heat-control circuit for the purpose of controlling the ignition time point of the mixture when the temperature-control has reached its limit. A comparator is provided to monitor the heat-control circuit and to activate the ancillary control circuit if necessary.

6 Claims, 1 Drawing Figure

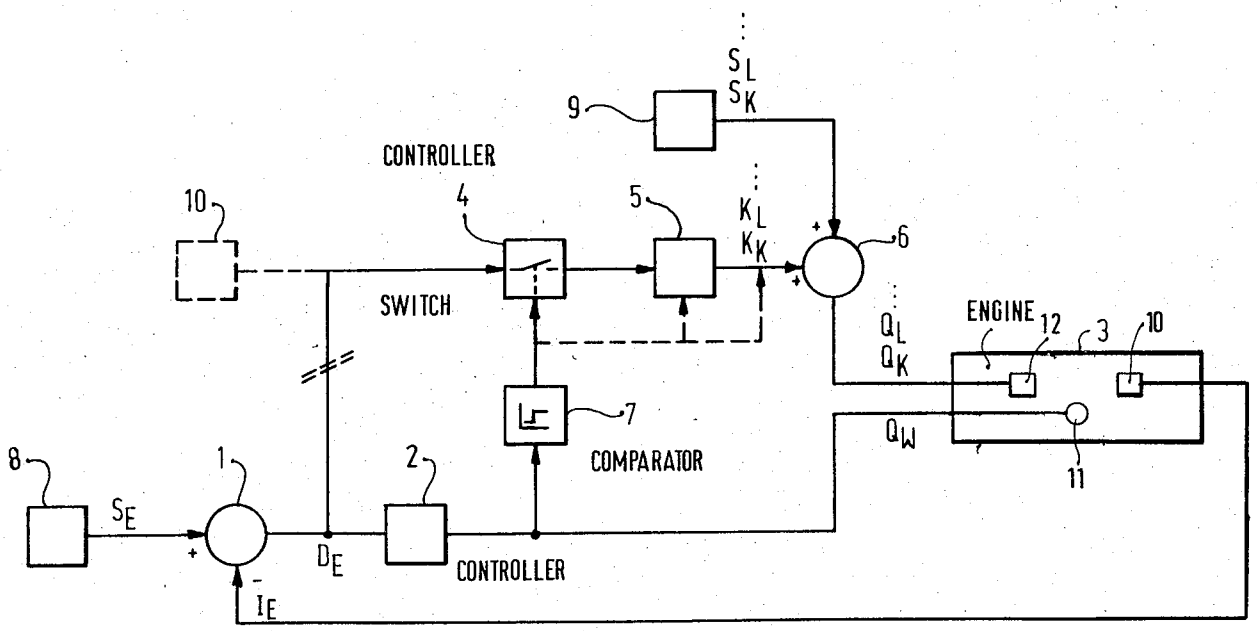
ENGINE
CONTROLLER
SWITCH
COMPARATOR
CONTROLLER
$S_L$
$S_K$
$K_L$
$K_K$
$Q_L$
$Q_K$
$Q_W$
$D_E$
$I_E$
$S_E$
1
2
3
4
5
6
7
8
9
10
10
11
12

ARRANGEMENT FOR CONTROLLING A INTERNAL COMBUSTION ENGINE EQUIPPED WITH GLOW PLUGS

BACKGROUND OF THE INVENTION

In German published patent application DE-OS 2,402,586, an internal combustion engine is described wherein the energy supplied to a hot spot from an external source is adjusted to the energy requirement of the hot spot via a control arrangement. Further, British Pat. No. 1,545,865 discloses a heat ignition system for internal combustion engines wherein the electric current supplied to the glow plug is adjusted in dependence on the deviation of the actual ignition point from the desired ignition point. In both publications, therefore, the time the combustion commences is controlled by influencing the temperature of the hot spot or the glow plug. However, particularly in the operating range close to full load, this can not be sufficient any more because the heat developed in the mixture itself continues to heat up the hot spot or the glow plug, as a result of which uncontrolled ignition may occur in the engine.

SUMMARY OF THE INVENTION

In contrast, the control arrangement according to the invention affords the advantage that the temperature control of glow-plug is monitored. For example, this can be done by controlling the fuel quantity pursuant to the principle of standby control. In this arrangement, the temperature control permits operation of the engine with the ignition point at its optimum. When the heat developed in the mixture continues to heat up the glow plug ever further causing the temperature control to reach its limit, the standby control becomes active thereby preventing an unstable behavior of the engine by changing, for example, the fuel quantity.

BRIEF DESCRIPTION OF THE DRAWING

The invention will now be described with reference to the drawing which shows the control arrangement of the invention in the form of a block diagram.

DESCRIPTION OF THE PREFERRED EMBODIMENT OF THE INVENTION

The block diagram of the drawing is a control arrangement for an internal combustion engine using glow plugs. The control arrangement includes a heat-control circuit and an ancillary control circuit for modifying further control quantities. In the particular embodiment shown, the ancillary control circuit modifies the amount of fuel admitted to the engine combustion chamber.

The heat-control circuit includes a subtracter 1, a controller 2, which is preferably a PID controller, a sensor 10 arranged with respect to the combustion chamber of the engine 3, and a glow plug 11 in the combustion chamber of the engine 3.

Applied to the inputs of subtracter 1 are the desired ignition time point $S_E$ and the actual ignition time point $I_E$. The resulting ignition time point difference value $D_E$ which is present at the output of subtracter 1 is applied to the input of controller 2. The output quantity of controller 2 is a signal indicative of a heat quantity $Q_W$ which is fed to the glow plug 11 in the combustion chamber of engine 3. The value of the actual ignition time point $I_E$ determined by the sensor 10 in the combustion chamber of engine 3 is fed back to subtracter 1.

The desired-value ignition time point $S_E$ is fed to subtracter 1 by a desired-value generator 8.

The fuel-quantity control circuit includes the subtracter 1, a switch 4, a controller 5, which is preferably a PID controller, an adder 6, a fuel-metering device 12 arranged with respect to the combustion chamber of engine 3, and the sensor 10 in the combustion chamber of engine 3.

The difference value $D_E$ for the ignition time point formed by subtracter 1 is applied to the input of controller 5 via switch 4. The output of controller 5 is a correcting value of the fuel-quantity $K_K$ which is applied to an input of adder 6. Applied to another input of adder 6 is a desired-value fuel quantity $S_K$ which is generated by a desired-value generator 9. The resulting output value of adder 6 represents a signal indicative of a fuel quantity $Q_K$ which is supplied to the fuel-metering device 12 in the combustion chamber of engine 3. The fuel-quantity control circuit is closed by the feedback to subtracter 1 already referred to above and by the formation of the difference of desired value and actual value of the ignition time point resulting in the difference value $D_E$ for the ignition time point.

A comparator 7 establishes the connection between the heat-control and fuel-quantity circuits. Comparator 7 receives as its input signal the heat quantity $Q_W$ to be supplied to the glow plug 11, and with its output signal, the comparator controls and actuates the switch 4.

As long as the heat quantity $Q_W$ supplied to the combustion chamber of engine 3 by means of the glow plug 11 is greater than zero, comparator 7 does not respond, switch 4 is open, and the fuel-quantity control circuit is not in operation. Accordingly, in this operating condition, the ignition time point of the mixture in the combustion chamber of engine 3 is only influenced by the heat-control circuit. In this arrangement, the controller 2 provides an appropriate heat quantity $Q_W$, thereby attempting to make the ignition time point difference value $D_E$ generated at the output of subtracter 1 reach zero value. As the fuel quantity $Q_K$ in this condition of operation, the combustion chamber of engine 3 is supplied with the desired value for the fuel quantity $S_K$.

Now if the heat quantity $Q_W$ supplied to the glow plug 11 in the combustion chamber of engine 3 is equal to zero, which can result from a high amount of heat developing in the mixture and the consequent heating up of the glow plug 11, the heat-control circuit is no longer in a position to influence the ignition time point of the mixture. Comparator 7 detects this operating condition and closes switch 4 thereby activating the fuel-quantity control circuit. From the ignition time point difference value $D_E$, the controller 5 then generates a fuel-quantity correcting value $K_K$ which modifies the desired value fuel-quantity $S_K$. The new fuel quantity $Q_K$ thus obtained reduces the heat developing in the mixture and the resulting heating up of the glow plug 11. As a result, the actual-value ignition time point $I_E$ and thus also the ignition time point difference-value $D_E$ change. The fuel-quantity correcting value $K_K$ generated by controller 5 is applied to adder 6 until controller 2 generates again a heat quantity $Q_W$ greater than zero from the ignition time point difference-value $D_E$. Then switch 4 opens, the fuel-quantity circuit is disabled, and the heat-control circuit again by itself influences the ignition time point of the mixture.

It is possible to place controller 5 ahead of switch 4 and to use switch 4 to enable and disable the fuel-quantity correcting value $K_K$ which is formed continuously. Likewise, it is possible to incorporate the switching function of switch 4 into controller 5 directly.

Also, it is possible to use an open-loop fuel-quantity control circuit, that is, the fuel-quantity correcting value $K_K$ is a fixed value which is set by a correcting-value generator 10 and is therefore independent of the commencement of mixture combustion. In this case, controller 5 may be omitted.

Further, the switching point of comparator 7 is not necessarily fixed to zero value but may be set to any specific positive value.

The sensor 10 arranged with respect to the combustion chamber of engine 3 serves to indicate the commencement of combustion of the mixture. It is not necessary that this be accomplished by means of the ignition time point of the mixture, but other variables may be used as well, such as temperature change, pressure change, temperature, pressure.

As mentioned initially in the description of the embodiment, the principle of such a standby control is not limited to the example of fuel-quantity control as given herein, but may also be applied to other and several control and/or regulating quantities suitable for influencing the combustion of the mixture, such as air quantity, start of injection, duration of injection, EGR (exhaust gas recirculation) control pressure, charging-air pressure, valve control timing, compression ratio.

It is to be understood that the overall control arrangement presented in the invention is not restricted to an analog configuration but may also be realized by means of digital components.

It is understood that the foregoing description is that of the preferred embodiments of the invention and that various changes and modifications may be made thereto without departing from the spirit and scope of the invention as defined in the appended claim.

What is claimed is:

1. A control arrangement for an internal combustion engine equipped with glow-plug means, the control arrangement comprising:

desired-value generator means for generating a generator signal indicative of the desired ignition time point of combustion in a combustion chamber of the engine;

sensor means for detecting the actual ignition time point of said combustion and providing a sensor signal indicative thereof;

first circuit means responsive to said generator signal and said sensor signal for generating and adjusting a signal indicative of the heat quantity delivered to said glow-plug means;

comparator means for monitoring said heat-quantity signal and for providing an output signal when said heat-quantity signal falls beneath a predetermined value; and, second circuit means responsive to said output signal for adjusting a control quantity of the engine.

2. The control arrangement of claim 1, said second circuit means being a control circuit.

3. The control arrangement of claim 2, said control quantity being at least one of the control quantities selected from the group comprising: air quantity, start of injection, duration of injection, control pressure, charging-air pressure, valve control timing and compression ratio.

4. The control arrangement of claim 1, said comparator means including means for adjusting the setting at which said comparator means will respond to said heat-control signal.

5. A control arrangement for an internal combustion engine equipped with glow-plug means and a fuel-metering device for metering fuel to the combustion chamber means of the engine, the control arrangement comprising:

desired-value generator means for generating a generator signal indicative of the desired ignition time point of combustion in said combustion chamber means;

sensor means for detecting the actual ignition time point of said combustion and providing a sensor signal indicative thereof;

heat-control circuit means responsive to the difference of said generator signal and said sensor signal for generating and adjusting an electrical signal corresponding to the heat quantity delivered to said glow-plug means;

a comparator for monitoring said heat-quantity signal and for providing an output signal when said heat-quantity signal falls to zero;

fuel-control circuit means activable for changing the amount of fuel supplied to said combustion chamber means by the fuel-metering device; and, switch means for closing in response to said output signal thereby activating said fuel-control circuit means.

6. The control arrangement of claim 5 said fuel-control circuit means comprising:

desired-value generator means for generating a signal indicative of the desired fuel quantity to be metered to said combustion chamber means by the fuel-metering device;

a regulator for developing a signal corresponding to a corrective value for the amount of fuel to be supplied to said combustion chamber means; and, adder means for adding said desired fuel-quantity signal and said corrective value signal to form a signal for changing the amount of fuel supplied to said combustion chamber means by the fuel-metering device.

* * * * *